US005576731A

United States Patent [19]

Whitby et al.

[11] Patent Number: 5,576,731

[45] Date of Patent: Nov. 19, 1996

[54] DISPLAY LINE DISPATCHER APPARATUS

[75] Inventors: Rodney J. Whitby, Ermington; David R. Brown, East Roseville, both of Australia

[73] Assignee: Canon Inc., Tokyo, Japan

[21] Appl. No.: 489,634

[22] Filed: Jun. 12, 1995

Related U.S. Application Data

[63] Continuation of Ser. No. 177,450, Jan. 5, 1994, abandoned.

[30] Foreign Application Priority Data

Jan. 11, 1993 [AU] Australia ..... PL6762

[51] Int. Cl.[6] ..... G09G 3/36

[52] U.S. Cl. ..... 345/100

[58] Field of Search ..... 345/97, 98, 100; 348/412, 415, 440, 699, 700, 701

[56] References Cited

U.S. PATENT DOCUMENTS 5,019,904 5/1991 Campbell .
5,091,723 2/1992 Kanno et al. ..... 345/97

FOREIGN PATENT DOCUMENTS 90654 11/1982 Australia .
0288168 10/1988 European Pat. Off. .
0464620 1/1992 European Pat. Off. .

*Primary Examiner*—Jeffery Brier
*Attorney, Agent, or Firm*—Fitzpatrick, Cella, Harper & Scinto

[57] ABSTRACT

Display standards in common use for the display of computer or television images on high resolution displays, commonly assume that the output image will be displayed on a output device having a high refresh rate. A high refresh rate is normally required to avoid the viewer observing flicker, stilted motion or other visual artifacts if a lower refresh rate were used. It is difficult to drive a high resolution Ferroelectric Liquid Crystal Display at a high refresh rate. The subject apparatus is provided for using the memory function characteristics of such a display and driving such a display at a slower refresh rate while still maintaining the appearance of a device having a higher refresh rate by refreshing those portions of the screen where motion has been detected at a high rate and only occasionally refreshing the whole screen.

21 Claims, 13 Drawing Sheets

DISPLAY LINE DISPATCHER APPARATUS

This application is a continuation of application Ser. No. 08/177,450 filed Jan. 5, 1994, now abandoned.

FIELD OF THE INVENTION

The present invention relates to the display of images on a colour display apparatus such as colour computer displays and colour printers, and, in particular, the display of colour images on a raster colour display apparatus.

DESCRIPTION OF THE RELATED ART

The display of images on devices such as Cathode Ray Tubes (CRT) and twisted nematic-type liquid crystal displays (LCD) is a known art. High resolution colour CRT or LCD display devices in common use for the display of images are capable of displaying in the order of 1024 lines with 1280 pixels on each line. Each pixel can consist of red, green and blue colour information representing the intensity level of that pixel on the surface of the CRT. Additionally, common standards in use assume a refresh rate generally above 25 Hz and commonly 60 Hz.

The image is formed on the particular display by utilizing the persistence on a fluorescent screen in the CRT or utilizing a transmittance change of a crystal element in a LCD. The impression made by the light received by the eye from the screen persists for a small fraction of a second after the source is removed. In presenting many frames to the eye over each second, the eye integrates between each frame and there is created an illusion that the images are being displayed in a continuous fashion. To create the illusion of motion, enough complete frames must be shown during each second so that the eye will continually integrate between them. This effect can normally be produced by having a picture repetition rate greater than about 16 frames per second.

The rate of 16 frames per second, however, is not rapid enough to allow the brightness of one picture to blend smoothly into the next when the screen is darkened between frames. At this rate the screen will appear to 'flicker' if the image written on the screen does not have a long 'persistence' between flames. In common CRT type screens, the persistence normally lasts for only a very short interval and generally decays very rapidly before the CRT is updated by the next frame which is to be displayed. In an LCD type display, the element is chosen to have a relatively short response time to also simulate the effect of a CRT with a short persistence. Hence these devices often produce flicker if used at a low refresh rate.

It has been found that a picture repetition rate of 30 frames per second is not rapid enough to overcome flicker at the light levels produced by a CRT screen. One method adopted to alleviate the problems of flicker is to divide the input frame into two interlaced groups and to alternatively display each group, so that 60 views of the screen are presented to the eye during each second. For example, in the NTSC standard, the horizontal scanning lines of a frame are divided into two groups known as fields, one for the odd numbered lines of a frame and one for the even numbered lines. These fields are then alternatively displayed, giving a screen that appears to have a refresh rate of, for example, 60 Hz. This has been found to substantially reduce flicker problems and the NTSC standard is commonly used in displaying images.

As the number of pixels to be displayed is increased, the time available for the display of each pixel becomes increasingly limited. In the case of a system with a 1280 (lines)× 1024 pixels display and a frame frequency of 30 Hz (field frequency being 60 Hertz), the time to display a single pixel, ignoring any horizontal or vertical flyback time, is approximately:

$$\begin{aligned} \text{Pixel time} &= 1/(1280_{lines} \times 1024_{pixels} \times 30\ \text{Hz}) \\ &= 25.4\ \text{nanoseconds} \end{aligned}$$

As this is the maximum time available to change the colour value of a particular pixel, the colour displayed by each pixel element must be capable of being changed within this short time if the display is to faithfully reproduce an intended input image which is subject to change over time.

This interval is extremely short and, if the resolution of the display device is increased, the period becomes even shorter. For example, an increase of resolution to 1920 lines×2560 pixels would result in a time to display each pixel being reduced to about 6.78 nanoseconds. The response time of each pixel of the display device must be able to keep up with this shortened time. One way of increasing the time required for processing a pixel is to process all the pixels on a line at the same time. Although this procedure is normally not possible with CRT type displays, it is readily implemented in a liquid crystal type display where a whole line of pixel can be set at the same time.

In recent years, Clark and Lagerwall have proposed a ferroelectric liquid crystal device (FLCD) having a high speed responsive characteristic and a memory characteristic. U.S. Pat. No. 4,964,699 (Inoue) entitled 'Display Device', proposes a ferroelectric liquid crystal element display device (FLCD). However, it has been found in practice that, for the higher resolution required of modem computer and television displays, the response time of the ferroelectric element is insufficient to enable a high-speed ferro-electric display to display images at standard rates and resolutions such as the NTSC standard rate or even rates lower than this standard. This is the case even where a whole line of pixel is driven at the same time. As would be expected, this problem is accentuated when the resolution of the display is increased.

In relation to the memory characteristics of the ferroelectric form of display, it has been further found that the pixel elements maintain their state for a substantial period of time after being set to a particular state. Although this period of time can vary in practice, periods up to several hours have been measured, with displays with persistence levels in the order of minutes being produced.

SUMMARY OF THE INVENTION

It is an object of the present invention to provide a means by which an image intended to be displayed at a high frame rate can be displayed at a much lower frame rate on a display device having a memory characteristic.

In accordance with eh present invention, there is provided a display control apparatus for displaying an input image having a first refresh rate, on a display having a memory function and a second refresh rate, the second refresh rate being lower than the first, the apparatus being adapted to substantially maintain the motion characteristics of the image at the first refresh rate.

BRIEF DESCRIPTION OF THE DRAWINGS

A preferred embodiment of the present invention will now be described with reference to the accompanying drawings in which.

DESCRIPTION OF THE PREFERRED EMBODIMENT

In the preferred embodiment, a much lower display rate than would normally be required is achieved through the utilization of the longer persistence properties of a ferro-electric liquid crystal display element and updating only those regions of the screen around which a change has bene detected, combined with a periodic refresh of the other portions of the display screen after the elapse of a predetermined interval, thereby presenting the appearance of a display having a much higher refresh rate.

Figure 1:
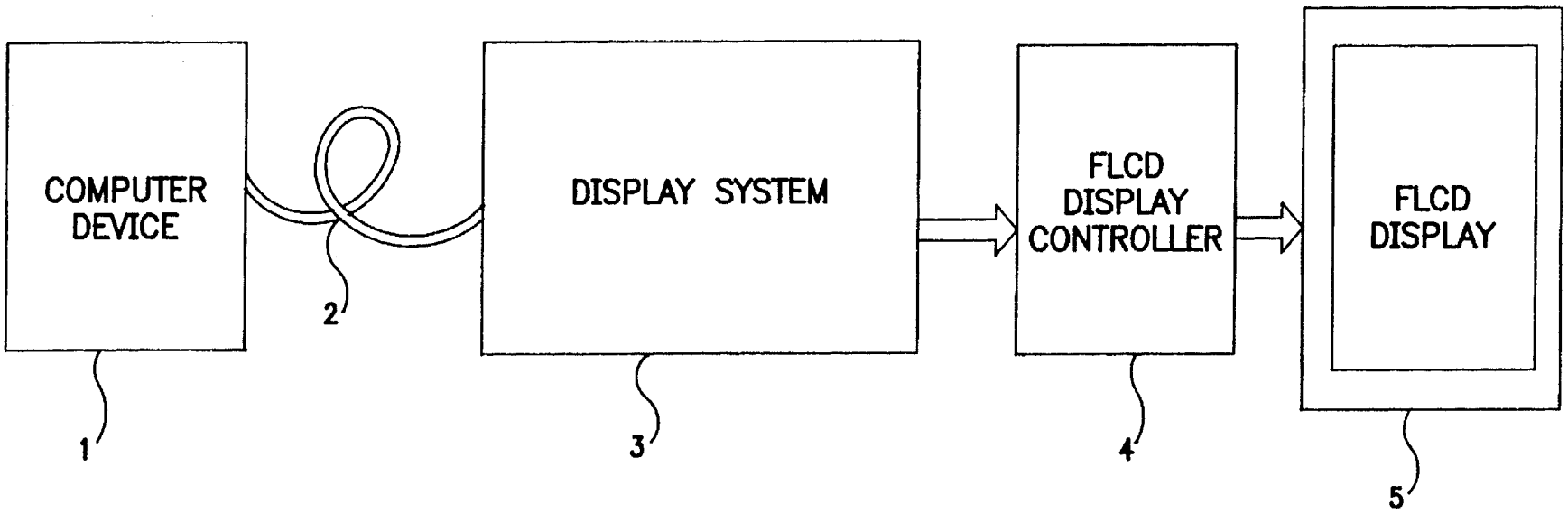
FIG. 1 is a schematic block diagram representation of a display arrangement for use with the preferred embodiment, and adapted to display the output from a computer device.

Referring now to FIG. 1, the preferred embodiment is configured as a display system 3 for displaying an RGB input on a FLCD type display device 5 having Red, Green, Blue and White primary pixel colours and driven by a display controller 4. The preferred embodiment also has application to other types of display devices 5 where it is desired to drive the display device 5 at a rate which is substantially slower than the rate of our image source such as a computer or television device 1. Typically, the FLCD display 5 is refreshed at a rate between 6 Hz and 15 Hz, and generally at about 8 Hz.

Figure 2:
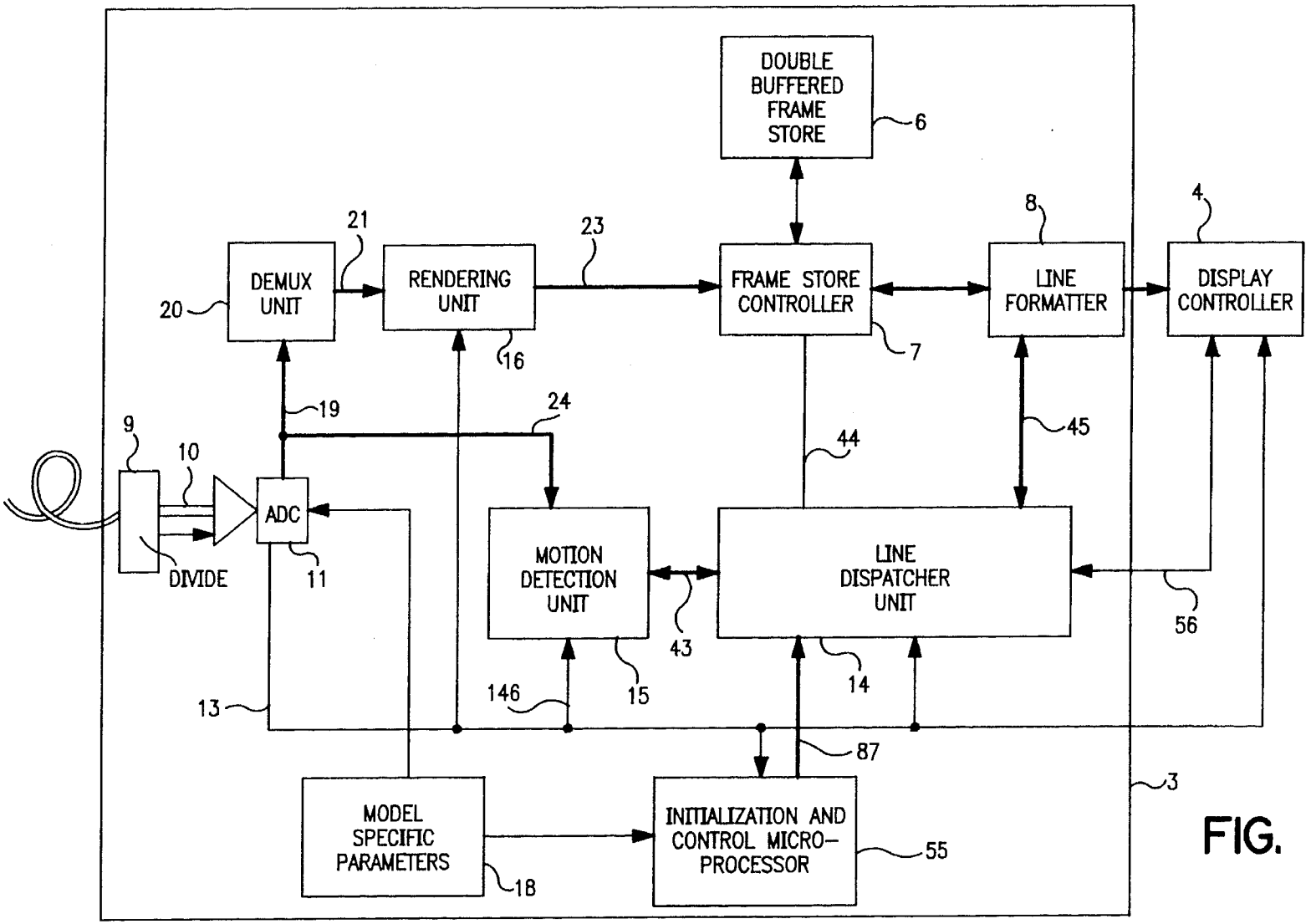
FIG. 2 is a schematic block diagram representation of the display system of FIG. 1.

In FIG. 2, the display system 3 is shown in greater detail. The display system 3 operates to determine from input rasterised image data supplied over an input cable 2, those pixels which have changed from frame to frame, and thereby utilizing the memory feature of the FLCD display 5, updating only those pixels that have changed. In general this is achieved by digitizing analogue data in an analog to digital converter (ADC) 11 and subsequently rendering pixels for display in a rendering unit 16. The rendered pixels are stored in a frame store 6.

The colour display system 3, also includes a motion detection unit 15. In operation of the preferred embodiment, the motion detection unit 15 produces, for each current line of the input, two 6-bit priority measures (average and edge priority measures) whose level is dependant upon changes that have occurred in the input image in comparison to an old input image. This priority measure is forwarded to a line dispatcher unit 14. Each line generates an edge priority and an average priority, each of which is an unsigned value, with larger values representing larger amounts of motion on the corresponding line.

Figure 4:
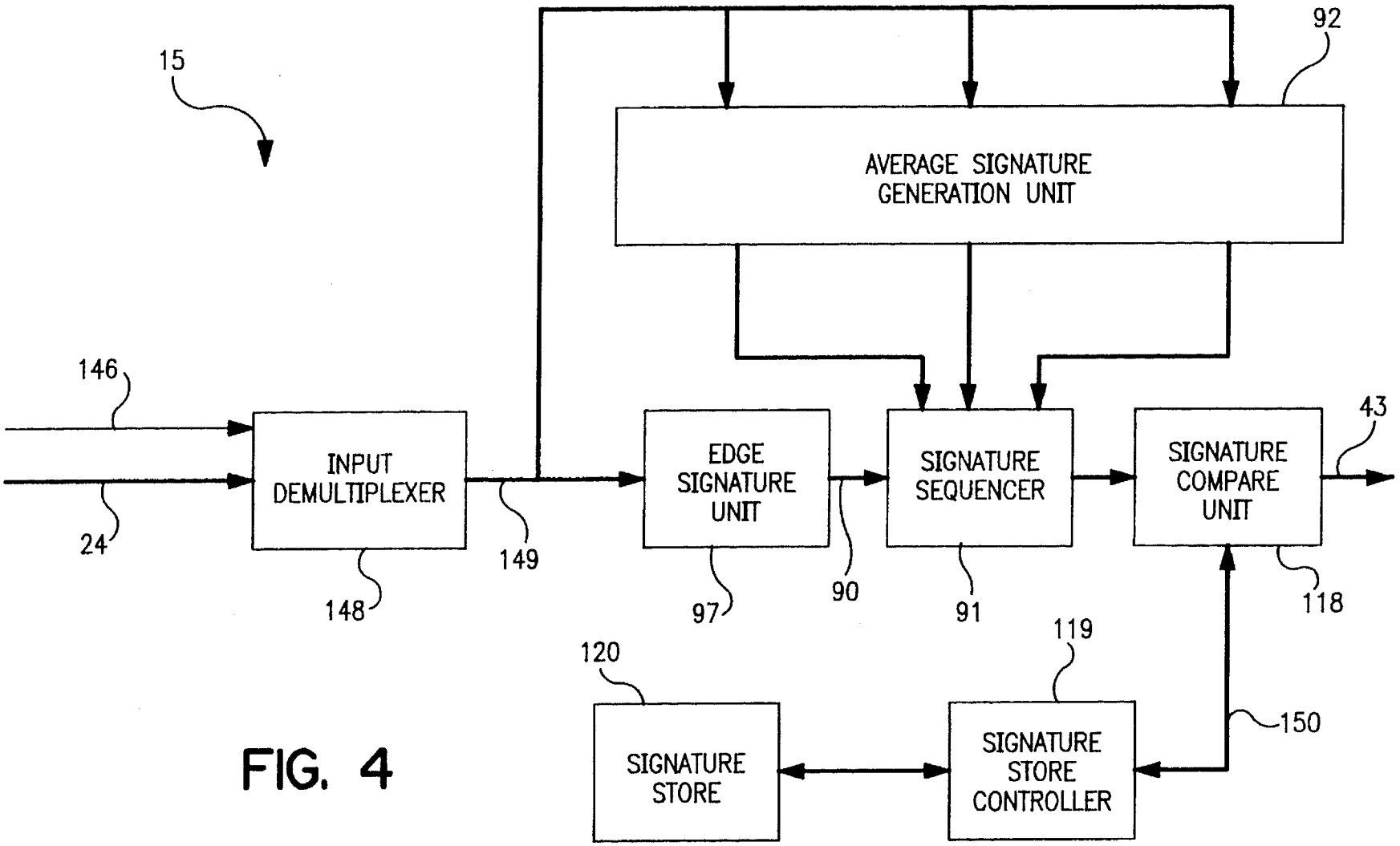
FIG. 4 is a schematic block diagram representation of the motion detection unit of FIG. 2.

Turning now to FIG. 4, the motion detection unit 15 is shown in more detail. The motion detection unit 15 receives input from motion detector input bus 24. This bus includes one channel cable of carrying two pixels at a time, and an associated control information channel 146. In order to ease the processing speed requirements, the pixel information 24 is further demultiplexed by input demultiplexer 148, whereby two groups of two pixels are grouped together so that the rest of the motion detection unit 15 operates on groups of four pixels. By reducing the speed requirements at which the motion detection unit 15 must operate, an implementation in a more economical technology is possible. Hence groups of four pixels, each of 24 bits, are output on a bus 149.

The red, green and blue individual primary colour portions of each pixel in addition to relevant control information is fed to an average signature generation unit 92. The average signature generation unit 92 implements, on each primary colour portion of the image, a first motion detection method conveniently called an 'average signature method' of determining a priority for the updating of a given line of the screen. This method determines a specific summation of an 'average region' of pixel values of a line as will be described hereinafter, and outputs an average signature value to a signature sequencer 91 for each region of a line.

The input pixels are also fed to an edge signature unit 97 which uses them to determine a set of edge values in accordance with an 'edge detection method', to be described hereinafter. One set of edge values is output to the signature sequencer 91 for each predetermined 'edge region'. An edge region being different from an area region.

The area values and edge values are both output to the signature sequencer 91, which packs these values into a 48-bit sample and outputs the sample to a signature compare unit 118.

The signature compare unit 118 takes the samples from the average signature sequencer 91 and samples from a previous frame, which have been stored in a signature store 120 and are input via a signature store controller 119, and determines two priority values for each line of the current input frame, outputting the values on line dispatcher bus 43.

The frame store 6, stores two sets of 4 bits of data for each pixel location of the FLCD display 5. Therefore, for a 1024 by 1280 display size, the total storage is about 2×5 Megabits. The frame store 6, is preferably configured as two frame stores in the configuration known as a 'double buffer'. Incoming halftoned pixels from the rendering unit 16, are stored in one half called a 'write' frame store, while the other half, called a 'read' frame store, which has been filled with a previous frame, is used for forwarding data to the FLCD display 5, via the display controller 4 and under the direction of a line dispatcher unit 14. The actual physical part of the frame store of the double buffer that corresponds to the current 'read' or 'write' frame store at any one particular time is determined on a group by group basis by the line dispatcher unit 14. A group is taken to be 4 lines. The process of determination of read and write frame store will be further outlined below.

The line dispatcher unit 14, which works in terms of a 'dispatch cycle', is responsible for selecting which part of the frame store 6 is used to store each line of the incoming frame, and which part of the frame store 6 is used to update each line to the FLCD display 5. The determination of which half of the frame store 6 corresponds to the read half and which half corresponds to the write half is made on a group by group basis, a group being four lines. Therefore, lines which are in adjacent groups may be stored in different buffers and, it is necessary to ensure that mixed reads and writes to a line in the same buffer do not occur. The protocol for doing this involves specifying a swap bit for each group which determines the buffer in which the incoming line of video data should be stored, and consequently the buffer from which each outgoing line of video data should be read. Each swap bit corresponds to one group of lines. The set of swap bits must not be changed when data is being written to or read from the buffers. To allow this constraint to be met, it is sometimes necessary to inhibit the writing of incoming video data to the framestore.

The interface 45, between the line dispatcher unit 14 and the line formatter 8 is in the form of data representing the line which should be dispatched to the FLCD display 5, and relevant handshake control signals. The rate at which lines can be dispatched to the FLCD display 5 is much less than the rate at which lines are received from the ADC 11. For the purposes of explanation, the fastest line dispatch rate will be assumed to be about one quarter of the incoming line rate. Therefore, depending on the number of lines selected to form the dispatch cycle, it may be the case that the duration of a dispatch cycle will be much longer than the duration of an incoming frame.

A complete frame of incoming data must be examined before a set of lines can be selected for dispatch. Therefore, the shortest dispatch cycle is equal in duration to an incoming frame. A dispatch cycle does not need to be an integral number of frames in duration, due to the ability to swap logical frame and signature buffers in the middle of an incoming frame by previously inhibiting writing to the frame buffer.

A new dispatch cycle is permitted to start when the line dispatcher unit 14 has completed dispatching the lines from the previous dispatch cycle, and a full frame of line priorities has been received from the motion detection unit 15.

Figure 3:
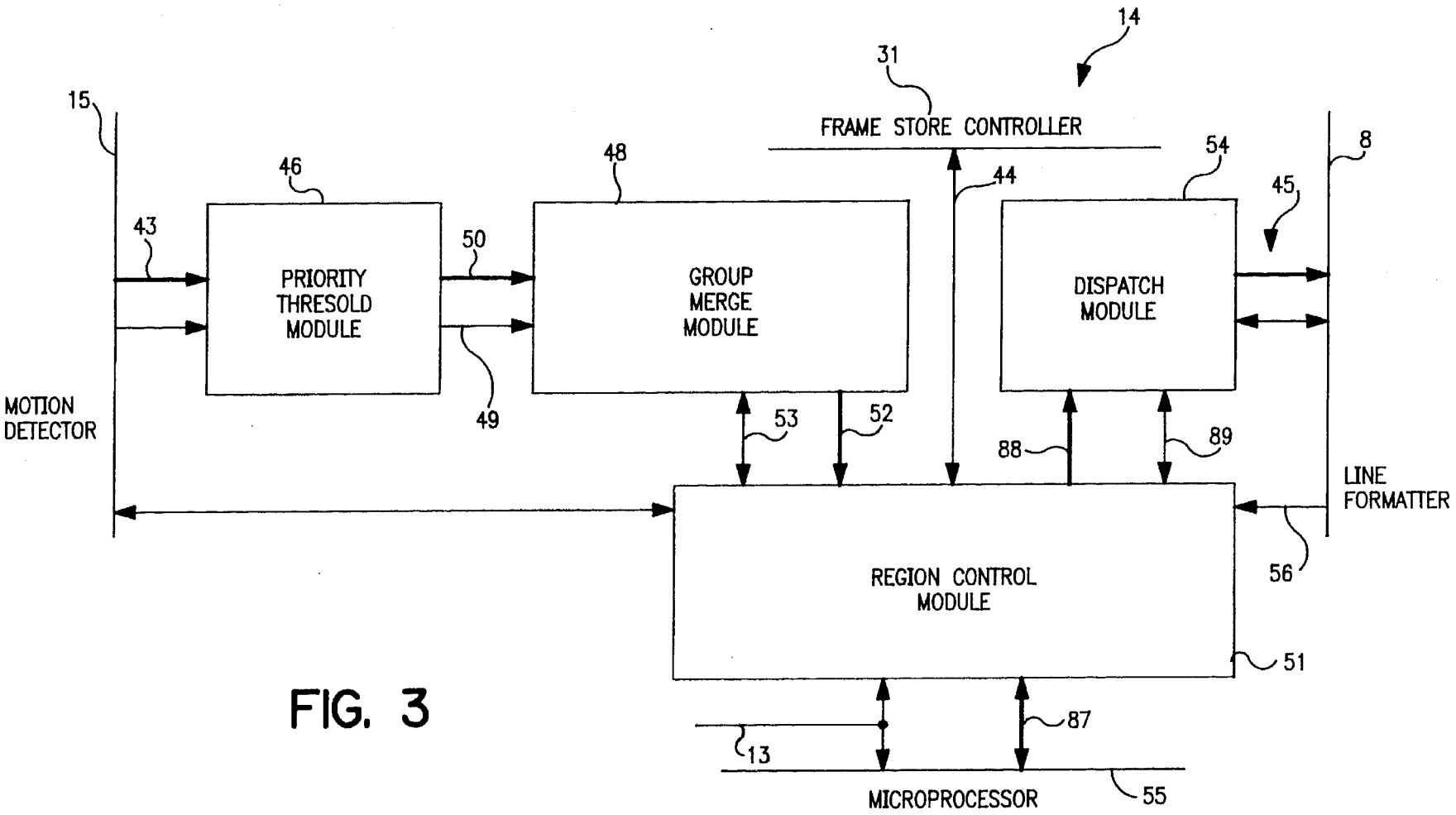
FIG. 3 is a schematic block diagram representation of the preferred embodiment.

Referring now to FIG. 3 there is shown the line dispatcher unit 14 in more detail. It consists of a priority threshold module (PTM) 46, group merge module (GMM) 48, region control module (RCM) 51 and dispatch module (DM) 54.

The priority threshold module 46 receives line priorities over a bus 43 from the motion detector 15, combines these line priorities into group priorities, and sends to the group merge module 48, any groups whose priority is greater than a predetermined noise threshold. The GMM 48 receives group priorities from the PTM 46 and forms regions from the new group priorities and the stored history of previous group priorities. It then determines which regions should be dispatched and sends these regions to the region control module 51. The RCM 51 receives regions from the GMM 48 and passes those regions to an initialization and control microprocessor 55 (FIG. 2) to store in a motion list. At the start of a dispatch cycle, the microprocessor 55 transfers the contents of the motion list to a dispatch list. During a dispatch cycle, the RCM 51 receives regions from the microprocessor 55 and passes those regions to the Dispatch Module (DM) 54. The DM receives regions from the dispatch list and sends the set of lines in each region to the line formatter 8 to be updated on the FLCD display 5. The order in which the constituent lines of a region are sent to the line formatter 8 is determined by the microprocessor 12. The DM 54 may also receive regions directly generated by the microprocessor, corresponding to a set of lines used to refresh the FLCD display 5.

Figure 5:
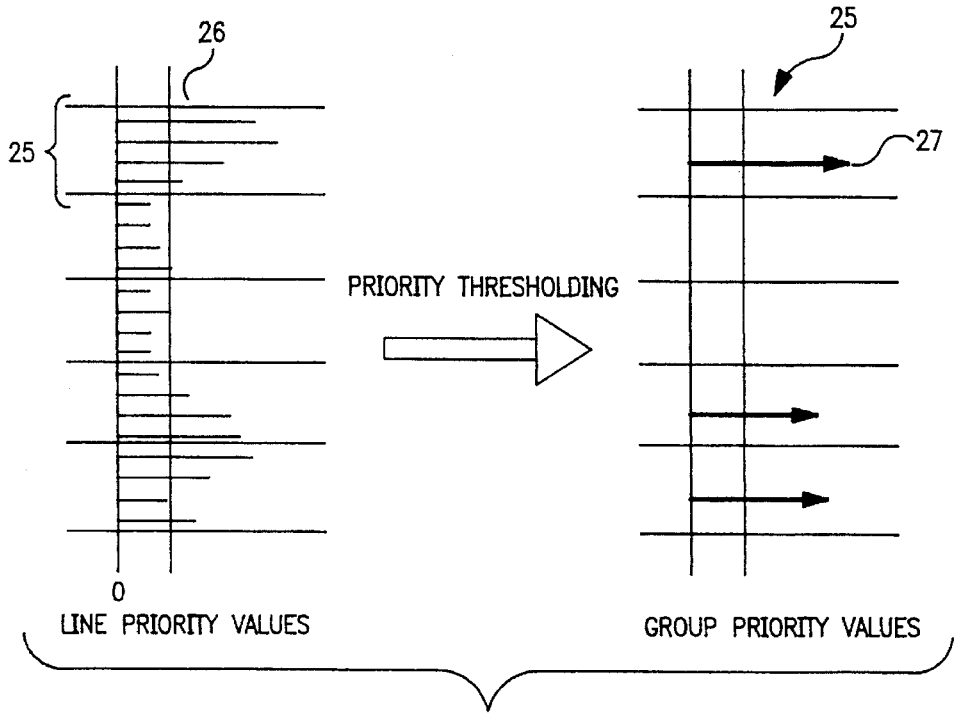
FIG. 5 illustrates the process of determining motion within groups of lines of an input image.

Referring now to FIG. 5, the process of group merging is shown. The presence of noise on the output of the AfD converter 11 will cause small variations in the line priorities received from the motion detection unit 15. The line dispatcher unit 14 is required to threshold the line priorities from the motion detection unit 15 before using them to select lines to be dispatched.

Line priorities from the motion detection unit 15 are examined in units of 'groups' with a group 25 being of programmable length (being 4, 8, 16 or 32 lines). For the purpose of explanation, the length of each group will be taken to be four lines. A value corresponding to an edge and average priorities for each line are compared with a set of corresponding programmable thresholds 26. The resulting detection group priority 27 is either zero (if none of the input line priorities was greater than the corresponding threshold), or the maximum of the priorities of the lines in that detection group. If the detection group priority 27 is greater than zero, then it is said that motion has occurred in that detection group.

A secondary function of the line dispatcher unit 14 is to detect regions of long-lived motion (that is movie regions) and to dispatch each complete movie region as an atomic unit to ensure that the movie is not "torn" due to updating some parts of the movie region and not others. This secondary function is achieved by storing attributes for each group of lines in an array, and by merging adjacent (or nearly adjacent) groups with certain attributes.

Each group has three attributes: Motion attribute, Movie attribute and Still attribute.

A group's motion attribute is set if motion has occurred on that group in the current dispatch cycle.

A group's movie attribute is set if motion has occurred in that group in the current dispatch cycle or a prior dispatch cycle. The movie attribute has an associated number (called the "time-alive") which records a multiple of the number of dispatch cycles (not necessarily consecutive) for which there has been motion on that group. The time-alive attribute saturates at a programmable maximum value.

A group's still attribute is set if there has been an absence of motion in that group for a number of consecutive dispatch cycles. The still attribute has an associated number (called the "time-dead") which records a multiple of the number of consecutive dispatch cycles for which there has been no motion on that group. The time-dead attribute saturates at a programmable maximum value.

If a group has both the movie attribute set, and the still attribute set, and the group's time-dead is greater than or equal to the group's time-alive, then the group's movie attribute is reset and the time-alive is reset to zero. The group's still attribute and time-dead are not changed, but will be reset the next time motion is detected for the group.

Any groups that are within a programmable spacing of one another, and have the movie attribute set, and also have either the motion attribute set or the difference between time-alive and time-dead greater than a programmable threshold, are then merged to form regions. These regions are then expanded by adding a programmable number of groups to form the start and end of a region.

Figure 6:
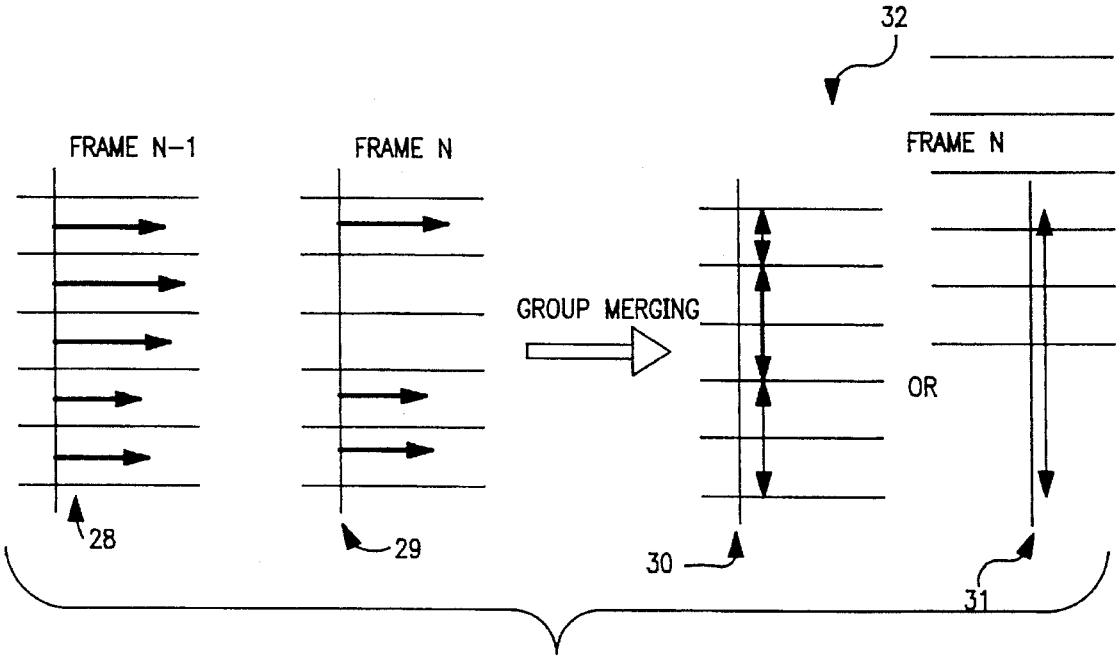
FIG. 6 illustrates the process of merging groups of lines into regions.

Referring now to FIG. 6, there is shown an example of the region formation process, whereby motion within groups is analysed over multiple frames 28, 29, so as to form regions 30, 31 with the actual regions formed being dependant on the predetermined programmable parameter values.

The regions are stored in a motion list within the microprocessor 55. At the start of a new dispatch cycle, regions are transferred from the motion list to a dispatch list in preparation for dispatch to the line formatter 8.

All the lines for the selected regions in the dispatch list are sent to the line formatter 8 in either a sequential or an interleaved order. Each region may be interleaved in isolation before moving on to the next region, or the complete set of regions may be interleaved in sequence. The interleave factor can be set to a number between 1 and 127 for each region.

Figure 7:
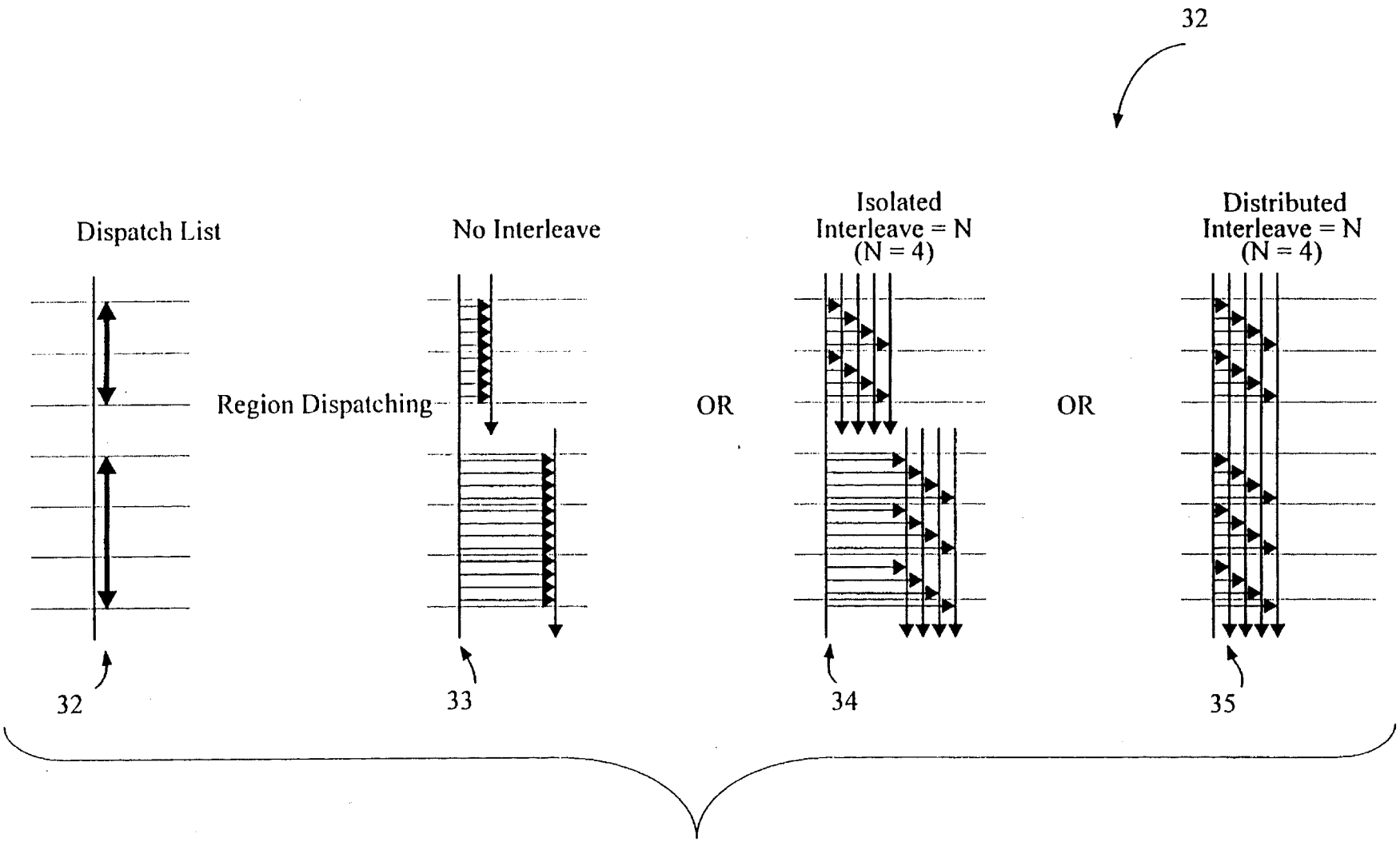
FIG. 7 illustrates the various methods of dispatching lines for display.

Referring now to FIG. 7, there is shown the different methods of dispatching lines to the line formatter 8. Given a set of regions 32, the corresponding lines can be dispatched on a line by line basis with no interleaving 33, or they can be dispatched in two different interleaving patterns being isolated interleaving 34 and distributed interleaving 35. In isolated interleaving 34 each region is dispatched in an interleaved fashion, with a first region being totally dispatched before any subsequent region is dispatched. In distributed interleaving 35 portions of each region are dispatched in an interleaved fashion.

The writing to and reading from the buffers is controlled by the line dispatcher 14 on a group-by-group basis. As mentioned previously, to enable the old data for lines in a frame to be dispatched while the new data for those lines is stored, two buffers are used. The writing to and reading from the read and write frame buffers is controlled by the line dispatcher 14 on a group-by-group basis.

Figure 8:
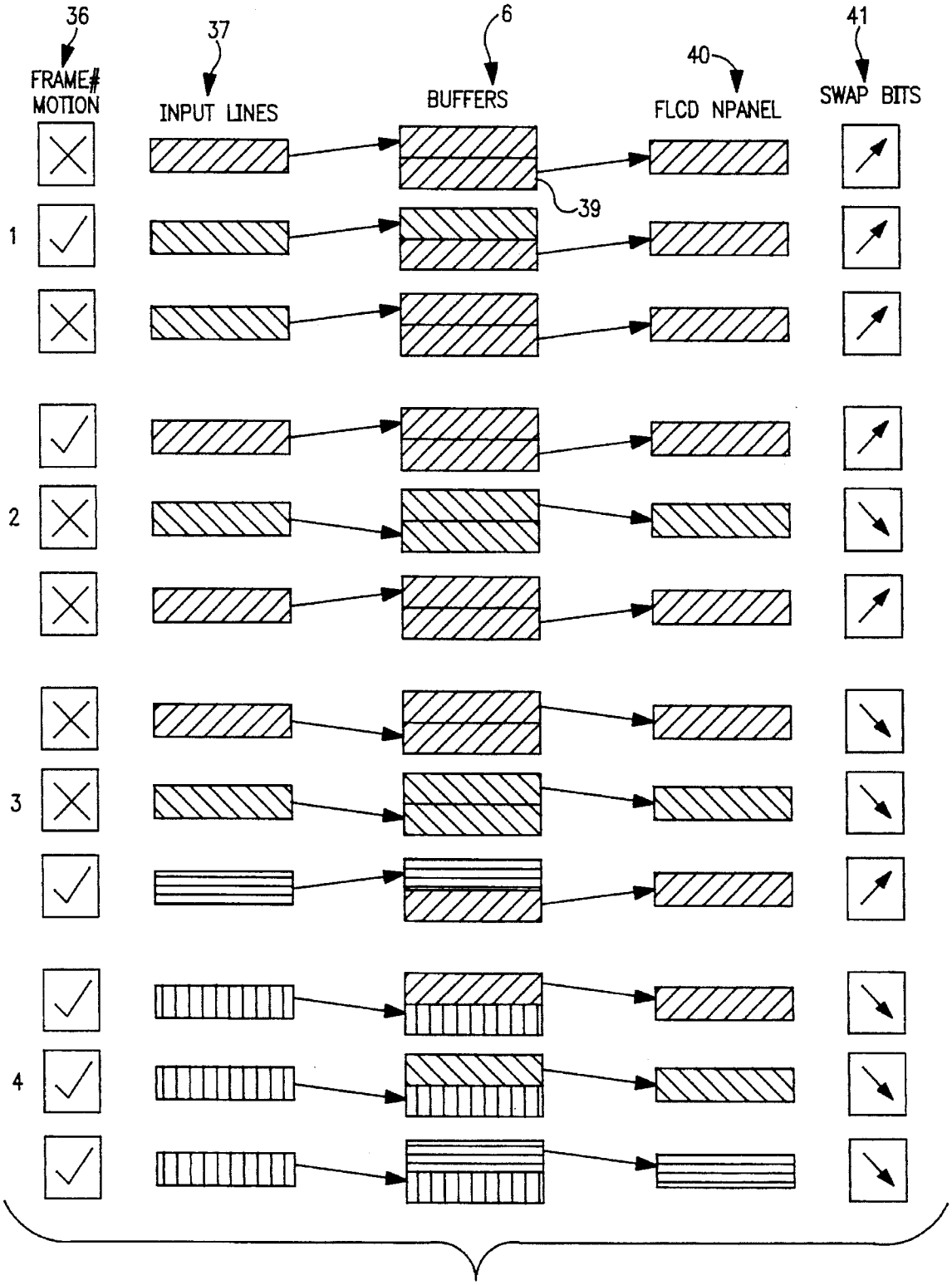
FIG. 8 illustrates the interaction with the line dispatcher unit with a double buffered frame buffer.

Referring now to FIG. 8, there is shown the allocation of lines to read and write buffers for a set of four incoming frames numbered 1 to 4. The illustration includes a motion indicator 36, an indicator of the input line contents 37, the frame buffer contents including current write buffer contents 38 and current read buffer contents 39, current FLCD panel contents 40 and swap bit indicator 41. For clarity of illustration, only three lines are shown for each frame.

The incoming lines for frame #1 are written into the buffers according to the swap bit settings. This means that the incoming lines will be written to buffer 0 (38), and the outgoing lines will be read from buffer 1 (39). The second line of frame #1 is selected for dispatch in the next dispatch cycle, causing the second swap bit to again be toggled during the dispatch cycle boundary at the end of frame #1.

The incoming lines for frame #2 are written into the buffers according to the swap bit settings. Lines 1 and 3 are written to buffer 0, and line 2 is written to buffer 1. At the same time, the line selected from the previous frame (line 2 from frame #1) is read from buffer 0 and dispatched to the FLCD display 5. The first line of frame #2 is selected for dispatch in the next dispatch cycle, causing the first swap bit to be toggled during the dispatch cycle boundary at the end of frame #2.

In the third frame, line 3 is written to buffer 0 and lines 1 and 2 are written to buffer 1. At the same time, the line selected from the previous frame (line 1 from frame #2) is read from buffer 0 and dispatched to the FLCD display 5. The third line of frame #3 is selected for dispatch in the next dispatch cycle, causing the third swap bit to be toggled during the dispatch cycle boundary at the end of frame #3.

In the fourth frame, all three lines are written to buffer 1. At the same time, the line selected from the previous frame (line 3 of frame #3) is read from buffer 0 and dispatched to the FLCD display 5.

It should therefore be noted that the incoming frame can always be stored in the buffers without overwriting the data that is currently displayed on the FLCD display 5.

Figure 9:
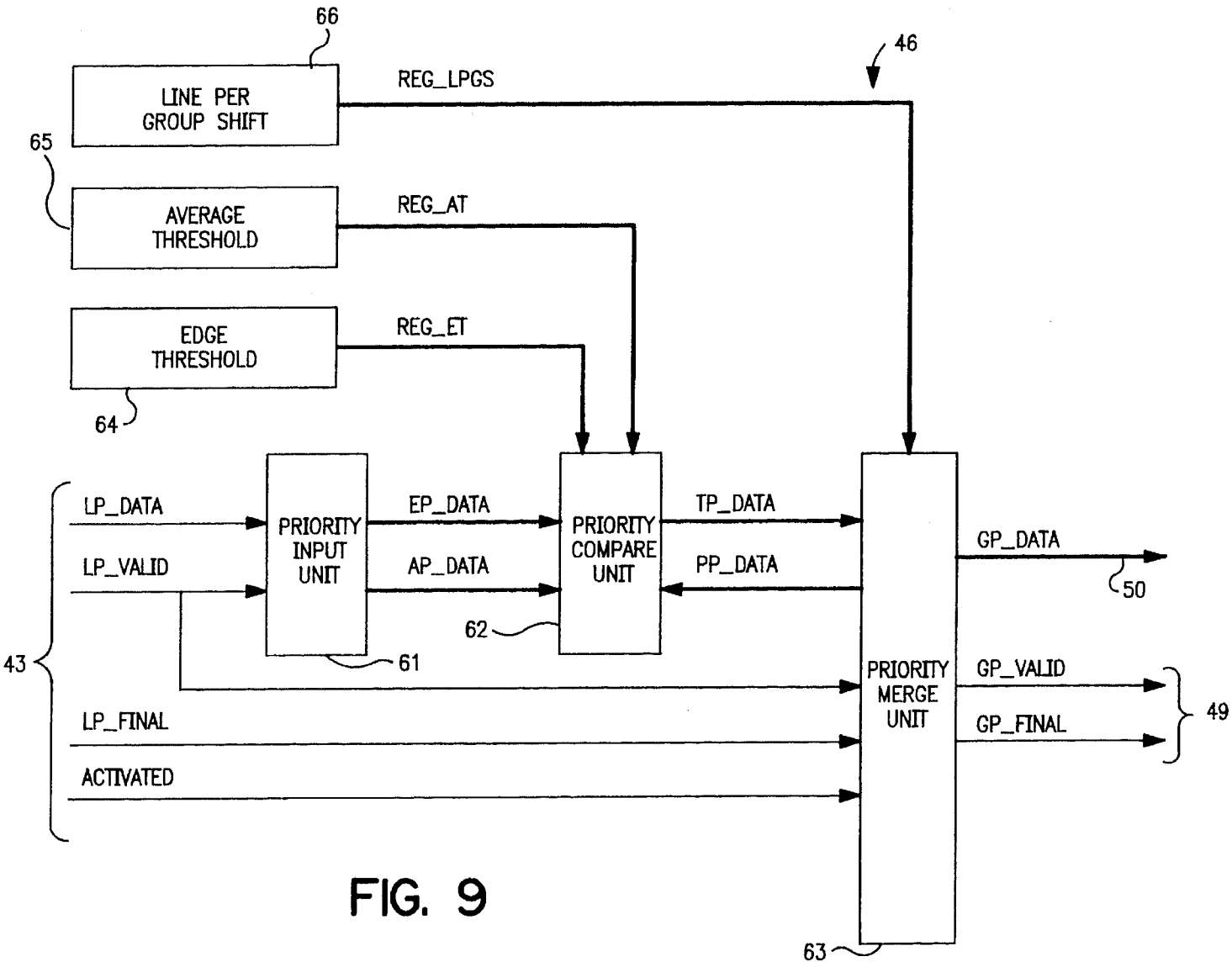
FIG. 9 is a schematic block diagram of the priority threshold module of FIG. 3.

Referring now to FIG. 9, there is shown the Priority Threshold Module (PTM) 46 which includes a priority input unit 61, a priority compare unit 62 and a priority merge unit 63.

The priority input unit 61 latches incoming line priorities (LP_DATA) from the motion detector and combines these to form group priorities. The incoming line priorities are in the form of edge priority values (EP_DATA) and average priority values (AP_DATA), forwarding them to the priority compare unit 62.

The priority compare unit 62, takes these inputs and outputs on TP_DATA to the priority merge unit 63, the largest of:

(1) zero;

(2) the edge priority values, if the edge priority values are greater than the value stored in an edge threshold register 64;

(3) the average priority values, if the average priority values are greater than the value stored in an average threshold register 65; and (4) the current group priority value (PP_DATA).

Figure 10:
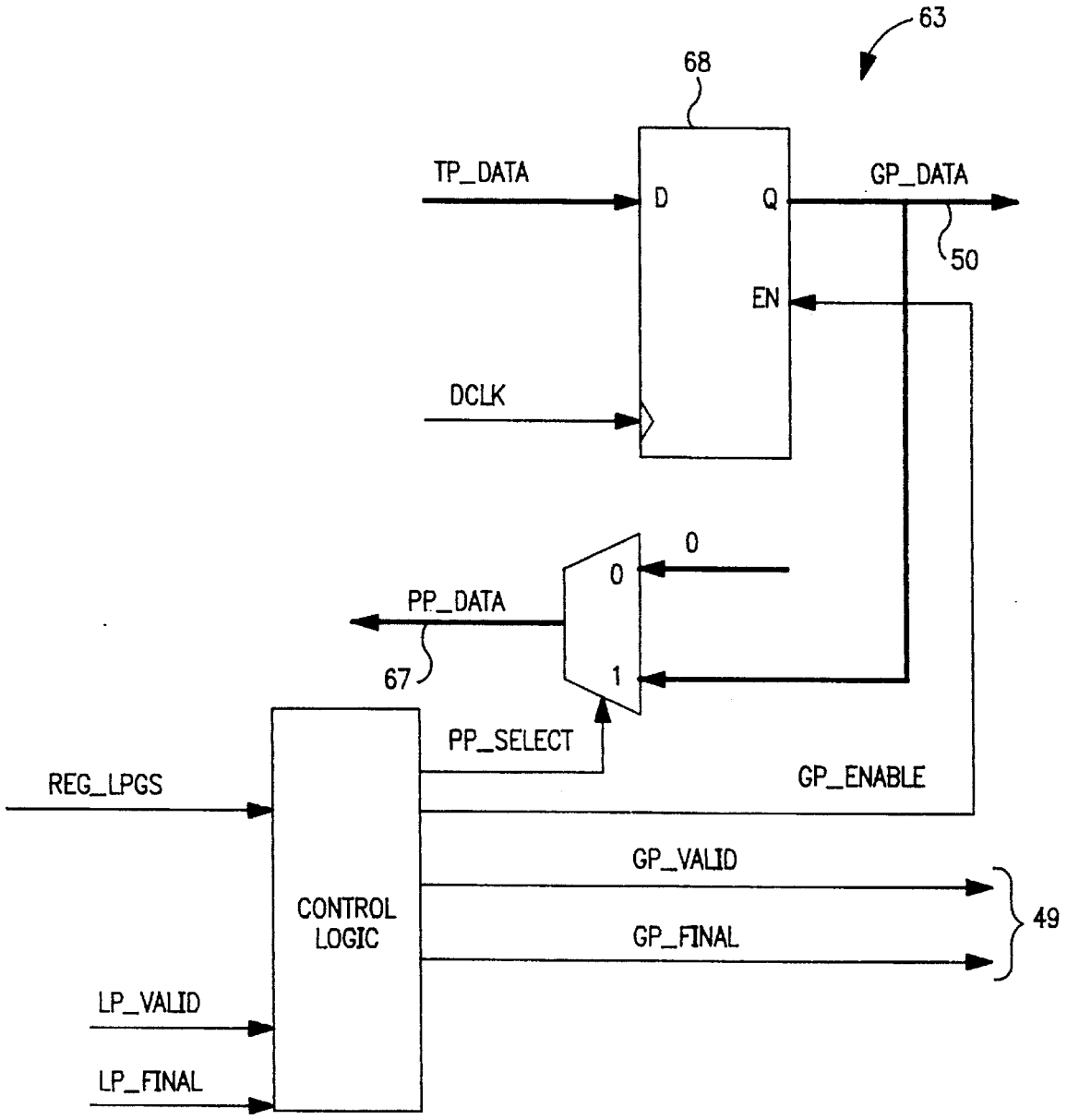
FIG. 10 is a schematic block diagram of the priority merge unit of FIG. 3.

Referring now to FIG. 10, there is shown, in more detail, the priority merge unit 63. The priority merge unit 63 initially zeros its PP_DATA data output 67 in readiness for the first line of a group. The value determined by the priority compare unit 62 is received by latch 68 (TP_DATA) and transferred to PP_DATA and GP_DATA for each line in the group. At the end of each group, the GP_VALID and GP_FINAL signals are generated and output along with the current group data (GP_DATA) and forwarded to the group merge module 48 (FIG. 11).

Figure 11:
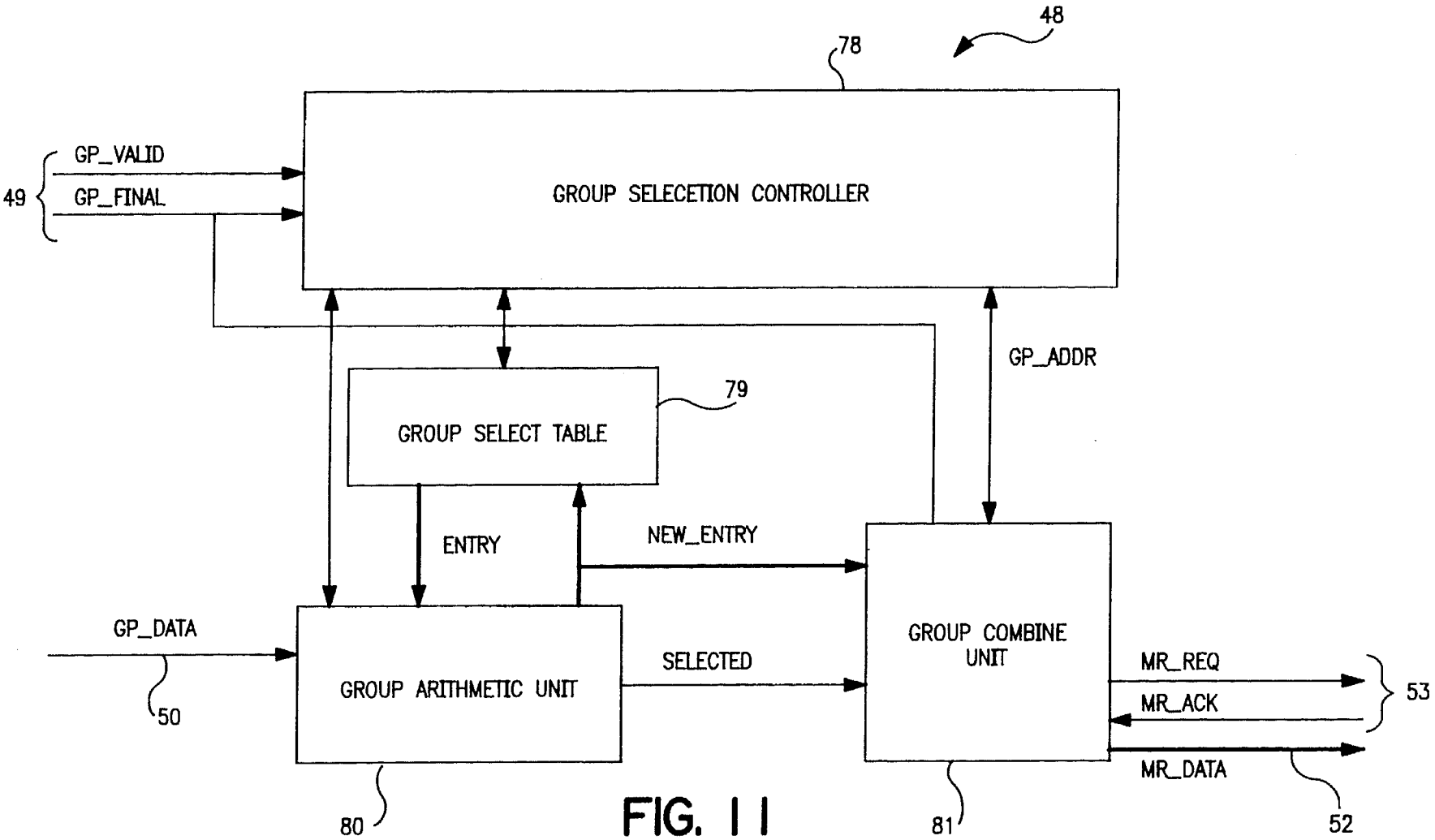
FIG. 11 is a schematic block diagram of the group merge module of FIG. 3.

Referring now to FIG. 11 the Group Merge Module (GMM) 48, is shown in more detail. The GMM 48 accepts the current group priority value and addresses from the PTM 46 and, in conjunction with previous group priorities, determines if the group should be combined into a region for forwarding to the RCM 51. The group merge module 48 consists of a group selection controller 78, a group selection table 79, a group arithmetic unit 80 and a group combining unit 81.

As mentioned previously, each group has three attributes which are stored in group selection table 79 and used in the creation of regions. The group selection table 79 consists of a 256 word RAM with each word consisting of 16 bits, and is used to store the attributes of each group being:

(1) MOTION: Set if motion has occurred on the group in the current dispatch cycle;

(2) MOVIE: Set if motion has occurred on the group is the current dispatch cycle or a prior dispatch cycle;

(3) TIME_ALIVE: A 6 bit number being a multiple of the number of dispatch cycles (not necessarily consecutive) for which there has been motion on the group;

(4) STILL: Set if there has been an absence of motion on the group for a number of consecutive dispatch cycles;

(5) TIME_DEAD: 6 bit number being a multiple of the number of consecutive dispatch cycles for which there has been no motion on the group; and (6) SPARE: Undefined.

The group arithmetic unit 80 uses the entry in the group selection table 79 and the priority of the incoming group to calculate NEW_ENTRY information to be stored in the group selection table 79. The new entry is calculated according to the following Pseudo Code:

```
if (GP_DATA>0) {
        MOTION = 1;
        MOVIE = 1;
        TIME_ALIVE = MIN(MovieMaximum, TIME_ALIVE[5:0] +
                                MovieIncrement);
        STILL = 0;
        TIME_DEAD[5:0] = 0;
}
else {
        MOTION = 0;
        STILL = 1;
        TIME_DEAD = MIN(StillMaximum,TIME_DEAD + StillIncrement);
}
if (MOVIE && STILL) {
        if (TIME_DEAD >= TIME_ALIVE) {
                MOVIE = 0;
                TIME_ALIVE = 0;
        }
}
```

The group arithmetic unit 80 also determines whether a group should be selected for update or not, generating a SELECTED signal for the group combining unit 81 according to the following criteria:

```
if (MOVIE &&
    (MOTION ||((TIME_ALIVE – TIME_DEAD)>Select Threshold))) {
        SELECTED = 1;
}
else {
        SELECTED = 0;
}
```

Figure 12:
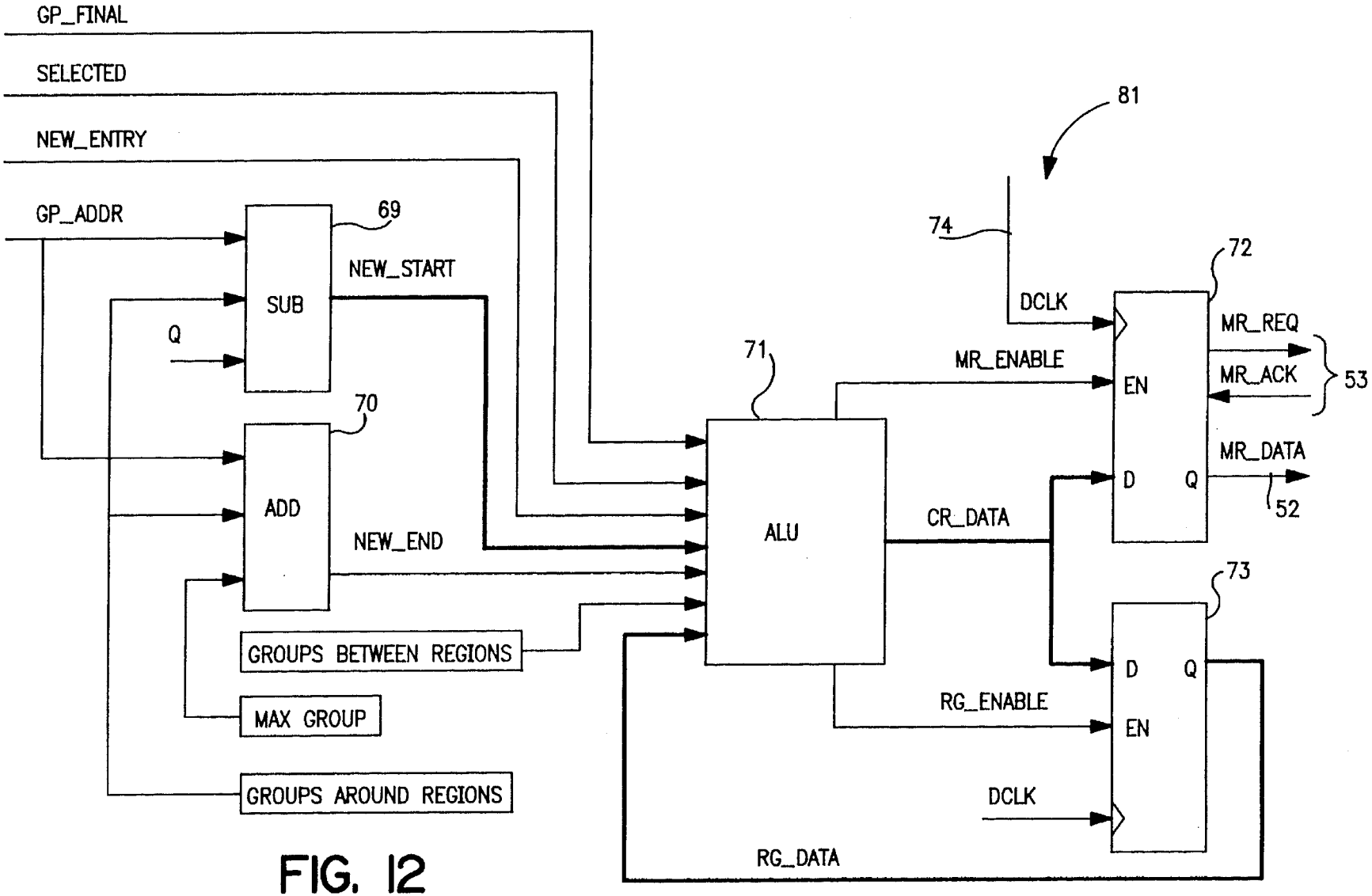
FIG. 12 is a schematic block diagram of the group combined unit of FIG. 11.

Referring now to FIG. 12, there is shown the group combining unit 81, which combines selected groups into regions and passes these regions to the region control module 51. The group combining unit 81 utilizes a number of internal registers (not shown) which store the value of the desired 'GroupsBetweenRegions' and 'GroupsAroundRegions'. Selected groups are combined if they are within (GroupsBetweenRegions+2*GroupsAroundRegions) of each other. If GroupsBetweenRegions is zero, then no groups are merged (i.e. each region contains one group only). After all possible groups for one region have been combined, the region is then expanded by adding GroupsAroundRegions groups to the start and end of the region.

A region (RG_DATA, CR_DATA) consists of the following information:

START: The region start group address;

END: The region end group address;

PRIORITY: The maximum of each GP_DATA of each group within a region;

MOTION: Set if any of the region's selected groups MOTION attributes are set;

TIME_DIFF: The maximum of the absolute difference between TIME_ALIVE and TIME_DEAD for the selected groups of a region;

MOVIE: Set if any of the region's selected group MOVIE attributes are set; and

STILL: Set if any of the region's selected group STILL attributes are set.

The group combining unit 81 utilises a number of internal signal groups. These signal groups are formed as follows:

NEW_START is formed by subtraction unit 69 by first subtracting GroupsAroundRegions from GP_ADDRESS and taking the maximum of the resultant and zero; and NEW_END is formed by addition unit 70 by taking the addition of GP_ADDRESS and GroupsAroundRegions and comparing it to the value MaxGroupInFrame.

The values for NEW_START, NEW_END and NEW_ENTRY are fed to an arithmetic logic unit (ALU) 71 in addition to the previous region's information (RG_DATA). Together these values form a new current region (CR_DATA). Regions will include attributes calculated from the group attributes of the selected groups comprising the region (before expansion by GroupsAroundRegions). The new current region can then replace the old region (RG_DATA) on the occurrence of a RG_ENABLE and the data can be driven out (MR_DATA) to region control module 51 on the occurrence of an MR_ENABLE.

Referring again to FIG. 11, the group selection controller 78 coordinates the operation of the group arithmetic unit 80, group selection table 79 and group combining unit 81. Once the group merge module 48 has formed a region, it is output to the microprocessor 55 via region control module 51.

The microprocessor 55 has two lists, namely a current input region list and a current output region list. The microprocessor 55, receives regions from the GMM 48 and stores these regions in a current input region list. When received regions overlap with previously received regions already stored in the current region list, the microprocessor 55 amalgamates the two overlapping regions to form one contiguous region which is stored in the current input region list. Regions are stored by incremental line orderings. The microprocessor 55 also contains a current output region list for dispatching regions to the DM 54.

Figure 13:
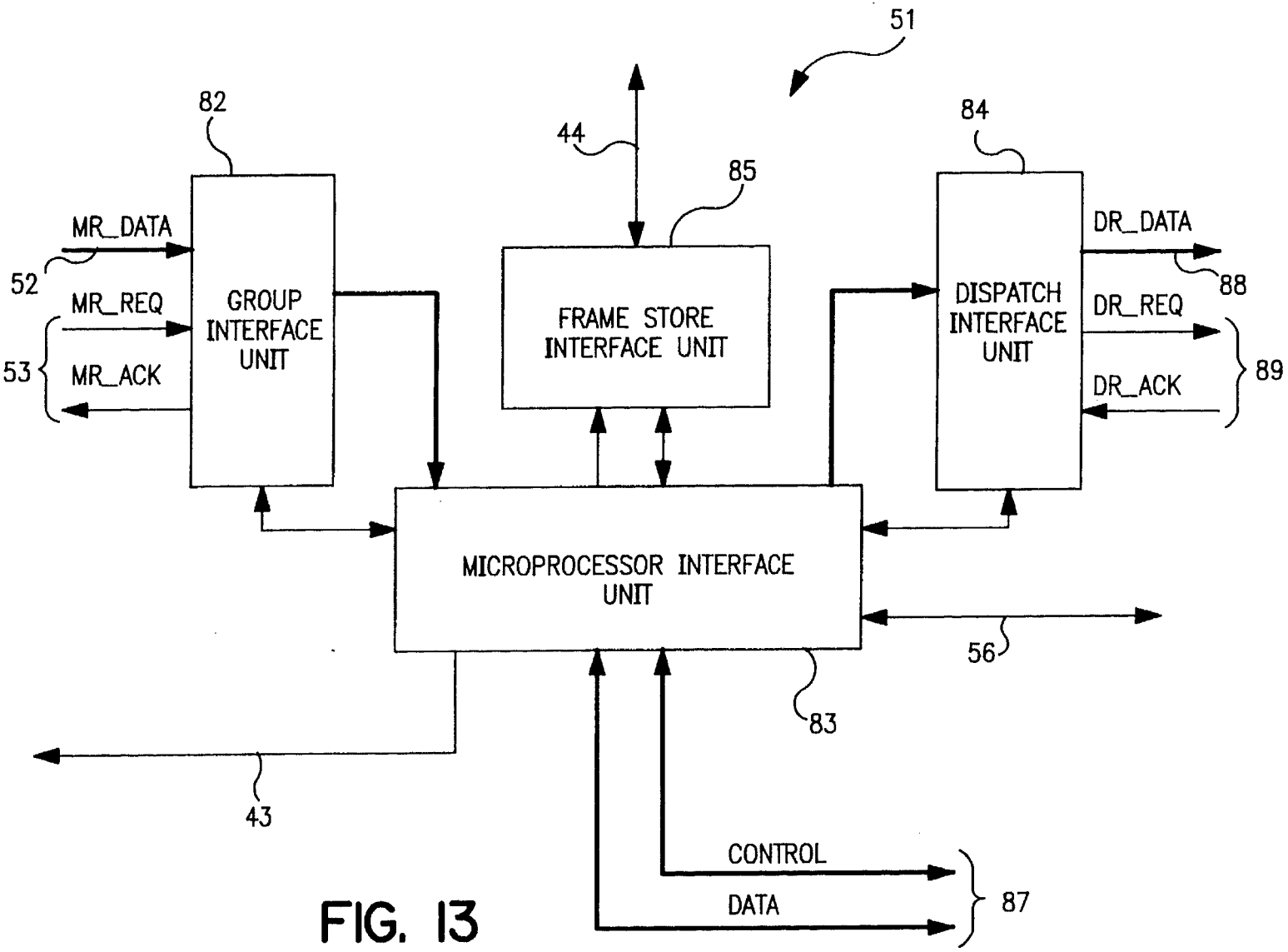
FIG. 13 is a schematic block diagram of the region control module of FIG. 3.

Referring now to FIG. 13 there is shown the schematic block diagram of the region control module 51. The region control module 51 acts as a microprocessor interface and is responsible for receiving regions from the group merge module 48 and forwarding them to the microprocessor 55, in addition to receiving regions from the microprocessor 55 and forwarding them for dispatch to the dispatch module 54. The region control module 51 consists of a group interface unit 82, a microprocessor interface unit 83, a dispatch interface unit 84 and a frame store interface unit 85.

The group interface unit 82 acts as a double buffer for regions received from the group merge module 48. This is to ensure that the interrupt latency of the microprocessor 55 does not cause overrun errors in the group merge module 48.

The dispatch interface unit 84 acts as a double buffer for regions sent to the dispatch module 54. This is to ensure that the interrupt latency of the microprocessor 55 does not cause the line formatter 8 to become idle in the middle of a dispatch cycle.

The frame store interface unit 85 handles the interface between the frame store controller 7 and the line dispatcher 14.

The microprocessor interface unit 83 allows the microprocessor 55 to receive regions from the group merge module 48 and to dispatch regions to the dispatch module 54. It also gives the microprocessor 55 access to and control over a number of signals to and from the group merge module 48, dispatch module 54, motion detection unit 15 and frame store controller 7.

Referring again to FIG. 3, the dispatch module 54 receives regions from the region control module 51 and generates dispatch addresses for the line formatter 8. This is achieved by taking the start and end addresses which are stored in each region and an interleave factor for the region to be dispatched, forwarded from the microprocessor 55, and then generating a sequence of line addresses for the region. The dispatch module 54 operates under the control of the microprocessor via the dispatch module 54, with its actions being dependent on the nature of the current dispatch cycle. All the lines for the selected regions in the dispatch list are sent to the line formatter 8 in either a sequential or an interleaved order. Each region may be interleaved in isolation before moving on to the next region, or the complete set of regions may be interleaved as a group. The interleave factor can be set to a number between 1 and 127 for each region. All the lines for the selected regions in the dispatch list are sent to the line formatter 8 in either a sequential or an interleaved order. Each region may be interleaved in isolation before moving on to the next region, or the complete set of regions may be interleaved as a group. The interleave factor can be set to a number between 1 and 127 for each region.

Regions are stored in a motion list in the microprocessor 55. At the start of a new dispatch cycle, regions are transferred from the motion list to a dispatch list in preparation for dispatch to the line formatter 8. The dispatch list also being stored within the microprocessor 55.

The actual methodology used to dispatch lines to the screen is therefore totally programmable within the microprocessor 55, thereby maximizing the systems flexibility. In the simplest case, the regions transferred to the dispatch list will be identical to the regions on the motion list from which they were derived. There are other more complex cases possible, and one such example will now be described with reference to FIG. 14.

In this dispatch method the microprocessor 55 usually relies on a number of different modes, the modes being as follows:

No Update Mode: When no lines have been selected for update, the microprocessor 55 does not need to dispatch any lines to the FLCD display 5.

Partial Update Mode: When a region has been selected for update, then the microprocessor 55 will instigate a dispatch cycle that will dispatch that set of lines to the FLCD display 5. The set of lines which were not selected for dispatch will retain their old data.

Background Refresh Mode: When a particular line is written to the FLCD display 5, the action of writing that line may degrade the storage capabilities of all other lines on the FLCD display 5. Therefore, all other lines that have previously been written to the FLCD display 5 are periodically re-written (or refreshed), to ensure that the degradation of the storage capabilities does not reach the point where it would impair the visual quality of the displayed lines.

Figure 14:
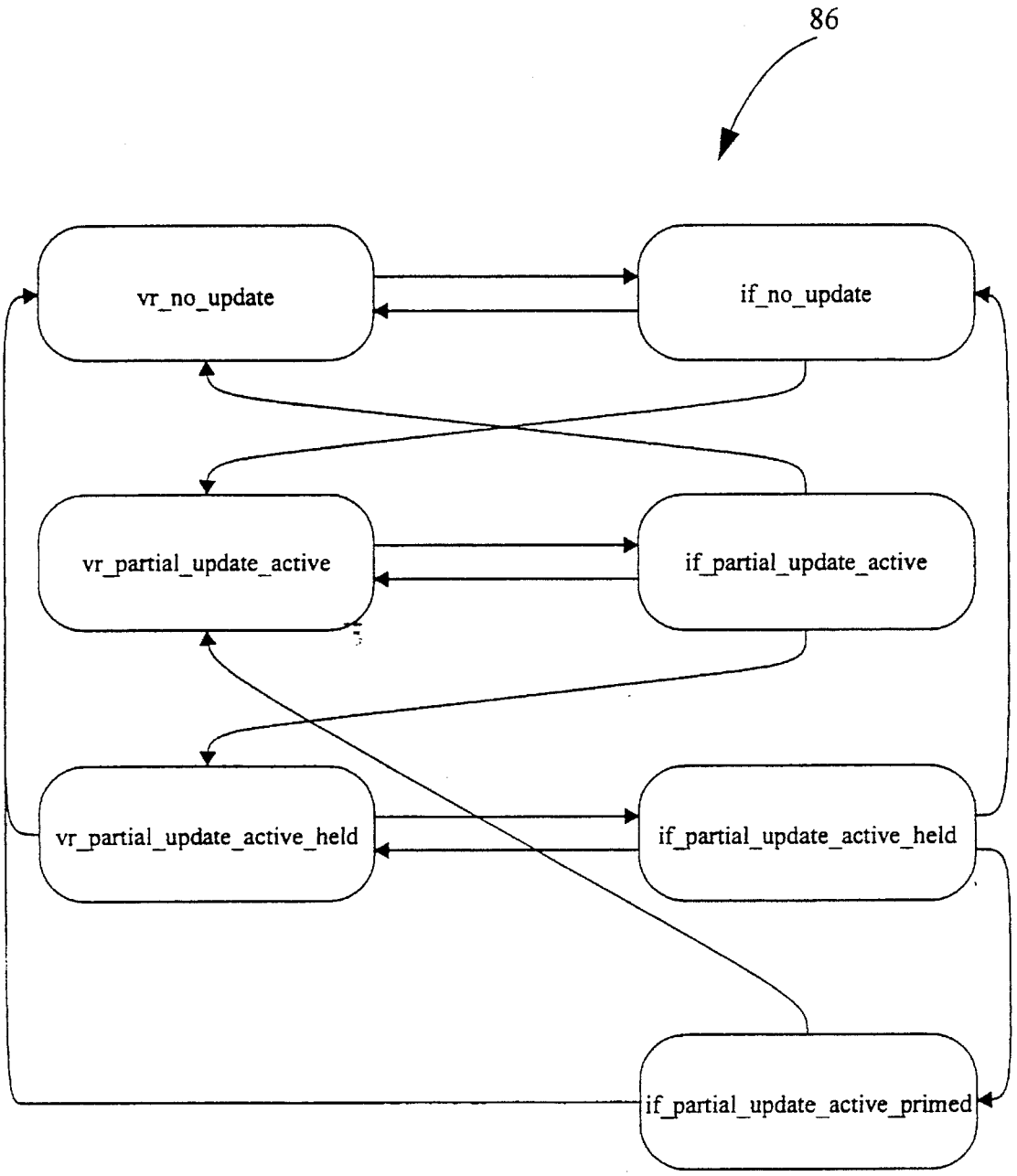
FIG. 14 illustrates a state machine implemented by the microprocessor to control updating of the display.

Additionally, the dispatch method is implemented in the form of a state machine as shown in FIG. 14.

A vr_no_update state is entered at the start of the vertical retrace period which is denoted by both the microprocessor 55, render and signature queues becoming idle An if_no_update state is entered when no lines have been selected for dispatch, and either the render or signature queue becomes busy (signalling the end of the vertical retrace period). If a set of lines has been selected for dispatch at the start of the next vertical retrace period, then a vr_partial_update_active state will be entered at the start of the next vertical retrace period. If no lines have been selected for dispatch at the start of the next vertical retrace period, then the vr_no_update state will be entered at the start of the next vertical retrace period.

A vr_partial_update_active state is entered when a set of lines has been selected for dispatch. Note that no data is written to either the frame buffer or the signature buffer during the vertical retrace period. A if_partial_update_active state is always to be entered at the end of the vertical retrace period.

The if_partial_update_active state is entered when a set of lines has been selected for dispatch. If the dispatch is completed before the start of the next vertical retrace period, either the vr_no_update state or the vr_partial_update_active state will be entered at the start of the next vertical retrace period. If the dispatch is not completed before the start of the next vertical retrace period, then a vr_partial_update_active_held state will be entered at the start of the next vertical retrace period.

The vr_partial_update_active_held state is entered at the start of the vertical retrace period when a dispatch has been started, but has not been completed. If the dispatch is completed before the end of the vertical retrace period, then the vr_no_update state will be entered at the end of the vertical retrace period. If the dispatch is not completed before the end of the vertical retrace period, then the if_partial_update_active_held state will be entered at the end of the vertical retrace period.

The if_partial_update_active_held state is entered at the end of the vertical retrace period when a dispatch has been started in a previous frame, but has not been completed. If the dispatch is completed before the start of the next vertical retrace period, then either the if_no_update state or the if_partial_update_active_primed states will be entered when the dispatch is completed. If the dispatch is not completed before the start of the next vertical retrace period, then the vr_partial_update_active_held state will be entered at the start of the next vertical retrace period.

A if_partial_update_active_primed state is entered when a dispatch is completed in the middle of a frame, and a set of lines has been selected for dispatch. If the dispatch is completed before the start of the next vertical retrace period, then the vr_no_update state will be entered at the start of the next vertical retrace period. If the dispatch is not completed before the start of the next vertical retrace period, then the vr_partial_update_active state will be entered at the start of the next vertical retrace period.

The forgoing describes a display control apparatus and line dispatcher unit for displaying an input image on a display having a low update refresh rate, whereby the display is normally required to be displayed on a display having a much higher refresh rate. This is accomplished by having the line dispatcher determine which lines must be updated as a matter of high priority and periodically updating the display of other lines in the image.

The foregoing also describes only one embodiment of the present invention particular to the RGB model for use with a RGBW ferro-electric liquid crystal display. However, other models and modifications to the present disclosure, obvious to those skilled in the art, can be made thereto without parting from the scope of the invention.

We claim:

1. A display control apparatus, comprising:

means for displaying an input image having a first refresh rate on a display having a memory function and a second refresh rate, the second refresh rate being lower than the first refresh rate;

means for detecting motion characteristics of the input image by comparing information of a portion of an image frame in a sequence of a plurality of the image frames; and means for maintaining the motion characteristics of the input image at substantially the first refresh rate.

2. A display control apparatus as claimed in claim 1, the apparatus further comprising:

reception means adapted to receive said information relating to the amount of change of lines of the input image;

grouping means adapted to receive said information from said reception means and to group together the lines into regions of an image that have changed, dispatching means adapted to cause the display of regions from said grouping means on said display, and timing means, adapted to cause said dispatching means to dispatch other regions where the image has not changed, at predetermined intervals.

3. A display control apparatus as claimed in claim 2, wherein said grouping means is also adapted to group together lines of the input image into groups of a predetermined length and to derive a measure of the amount of motion in each group, and further comprising region means adapted to group together said groups into contiguous regions.

4. A display control apparatus as claimed in claim 3, wherein said grouping means includes a storage means that stores, for each group, motion attributes of said group.

5. A display control apparatus as claimed in claim 4, wherein the motion attributes include one or more of a movie attribute, time alive attribute and time dead attribute, wherein the movie attribute is a measure of whether motion has occurred in a current group in a current dispatch cycle or a previous dispatch cycle, the time alive attribute is a measure of the number of dispatch cycles in which motion has occurred in a group, and the time dead attribute is a measure of the number of dispatch cycles in which no motion has occurred in the current group.

6. A display control apparatus as claimed in claim 3, wherein said region means determines, for each region formed, a region starting address, a region finishing address and a region priority value.

7. A display control apparatus as claimed in claim 3, wherein said predetermined length is one of 4, 8, 16, 32.

8. A display control apparatus as claimed in claim 3, wherein the information received by said reception means includes a motion value for each line of the image and said grouping means assigns a group motion value to each group of lines wherein the group motion value is one of zero or the maximum of the groups motion values which exceed a predetermined threshold.

9. A display control apparatus as claimed in claim 1, wherein the lines of a region are dispatched in an interleaved manner.

10. A display control apparatus as claimed in claim 9, wherein the lines of a region are dispatched in an isolated interleaved manner.

11. A display control apparatus as claimed in claim 9, wherein the lines of a region are dispatched in a distributed interleaved manner.

12. A display control apparatus as claimed in claim 1, wherein the second refresh rate is substantially lower than the first refresh rate.

13. A display control apparatus as claimed in claim 1, wherein the first refresh rate conforms to a display standard for a cathode ray tube display.

14. A display control apparatus as claimed in claim 1, wherein the second refresh rate relates to that required for operation of a ferro-electric liquid crystal display device.

15. A display control apparatus as claimed in any one of the preceding claims, wherein the first refresh rate is between 25 Hz and 60 Hz, and the second refresh rate is between 6 Hz and 15 Hz.

16. A display control system, comprising:

receiving means for receiving an input image having a first refresh rate on a display;

detecting means for detecting motion characteristics of the input image having the first refresh rate by comparing information of a portion of a frame of the input image with information of a corresponding portion in a subsequent frame of the input image;

converting means for converting the input image having the first refresh rate into an image having a second refresh rate in response to the detection by said detecting means; and a display for displaying the image having the second refresh rate.

17. A computer system comprising:

computer means for supplying an image having a first refresh rate on a display;

receiving means for receiving the image having the first refresh rate;

detecting means for detecting motion characteristics of the image having the first refresh rate by comparing information of a portion of a frame of the input image with information of a corresponding portion in a subsequent frame of the input image;

converting means for converting the image having the first refresh rate into an image having a second refresh rate in response to the detection by said detecting means; and a display for displaying the image having the second refresh rate.

18. A display controller, comprising:

receiving means for receiving an input image having a first refresh rate on a display;

detecting means for detecting motion characteristics of the input image having a first refresh rate by comparing information of a portion of a frame of said input image with information of a corresponding portion in a subsequent frame of the input image; and converting means for converting the input image having a first refresh rate into an image having a second refresh rate in response to the detection by said detecting means.

19. A display apparatus comprising:

a display controller including:

(a) receiving means for receiving an input image having a first refresh rate on a display;

(b) detecting means for detecting motion characteristics of the input image having a first refresh rate by comparing information of a portion of a frame of said input image with information of a corresponding portion in a subsequent frame of said input image; and (c) converting means for converting the input image having a first refresh rate into an image having a second refresh rate in response to the detection by said detecting means; and display means for displaying the image having the second refresh rate.

20. A computer system comprising:

a display controller including:

(a) receiving means for receiving an input image having a first refresh rate on a display;

(b) detecting means for detecting motion characteristics of the input image having a first refresh rate by comparing information of a portion of a frame of the input image with information of a corresponding portion in a subsequent frame of the input image; and (c) converting means for converting the input image having a first refresh rate into an image having a second refresh rate in response to the detection by said detecting means; and means for outputting the image having the second refresh rate.

21. A computer system, comprising:

computer means for supplying an image having a first refresh rate on a display;

receiving means for receiving the image having a first refresh rate;

detecting means for detecting motion characteristics of the image having a first refresh rate by comparing information of a portion of a frame of the input image with information of a corresponding portion in a subsequent frame of said input image; and converting means for converting the image having a first refresh rate into an image having a second refresh rate in response to the detection by said detecting means.

* * * * *

UNITED STATES PATENT AND TRADEMARK OFFICE

CERTIFICATE OF CORRECTION

PATENT NO. : 5,576,731

DATED : November 19, 1996

INVENTOR(S) : Whitby et al.

It is certified that error appears in the above-indentified patent and that said Letters Patent is hereby corrected as shown below:

COLUMN 2:

Line 61, "eh" should read --the--.

COLUMN 3:

Line 45, "bene" should read --been--.
Line 58, "our" should read --an--.

COLUMN 4:

Line 5, "3," should read --3--.

COLUMN 6:

Line 15, "AfD" should read --A/D--.

Signed and Sealed this

Eighth Day of July, 1997

Bruce Lehman

*Attest:*

BRUCE LEHMAN

*Attesting Officer*

*Commissioner of Patents and Trademarks*